US007765927B1

(12) United States Patent
Liu et al.

(10) Patent No.: US 7,765,927 B1
(45) Date of Patent: Aug. 3, 2010

(54) METHOD OF PRINTING ON ARTICLE OF CLOTHING USING AN ADJUSTABLE AREA PLATEN

(75) Inventors: Henry Hong Lin Liu, Fremont, CA (US); Robert Marino, Louisville, KY (US)

(73) Assignee: CafePress.com, Foster City, CA (US)

( * ) Notice: Subject to any disclaimer, the term of this patent is extended or adjusted under 35 U.S.C. 154(b) by 0 days.

(21) Appl. No.: 11/706,858

(22) Filed: Feb. 14, 2007

(51) Int. Cl.
*B41M 1/26* (2006.01)
*B41F 17/38* (2006.01)

(52) U.S. Cl. ..... 101/474; 101/41; 101/126; 101/487; 101/407.1

(58) Field of Classification Search ..... 101/41, 101/115, 126, 474, 487, 407.1; 347/4, 104, 347/8; 400/41, 48, 648
See application file for complete search history.

(56) References Cited

U.S. PATENT DOCUMENTS 4,753,164 A 6/1988 Barnes et al. ..... 101/126
4,890,401 A * 1/1990 Weisfeld ..... 38/43
5,247,885 A * 9/1993 Iaccino et al. ..... 101/474
6,408,745 B1 * 6/2002 Topolewski et al. ..... 101/126
6,640,714 B1 * 11/2003 Papa ..... 101/474
6,651,554 B1 * 11/2003 Williams ..... 101/126
6,908,190 B2 6/2005 Iwatsuki et al. ..... 347/104
7,413,301 B2 * 8/2008 Niimi et al. ..... 347/104

* cited by examiner

*Primary Examiner*—Leslie J Evanisko
(74) *Attorney, Agent, or Firm*—David H. Jaffer; Pillsbury Winthrop Shaw Pittman LLP

(57) ABSTRACT

A platen for use in printing on an object, wherein the platen has an adjustable area of a working surface on which to place the object. The platen surface includes a plurality of elements, wherein each element includes a flat surface that can be positioned at a working level at which the object is to be placed, and wherein an operator can insert or remove each element and thereby the corresponding flat surface of that element from the working level as required in order to provide a desired area of the working surface. In one embodiment, the platen includes a base plate and a plurality of elements which can be positioned on the base plate or removed to form a desired configuration of the working surface.

8 Claims, 6 Drawing Sheets

55
56
58
SAT 60
62
64

64

46
48

50
52

54

46
48
54

37
38

44
41
42

METHOD OF PRINTING ON ARTICLE OF CLOTHING USING AN ADJUSTABLE AREA PLATEN

BACKGROUND OF THE INVENTION

1. Field of the Invention

The present invention relates generally to platens for use in printing images, and more particularly to a platen having a plurality of moveable elements for adjusting the area of a platen surface.

2. Brief Description of the Prior Art

Platens provide a support surface for holding objects such as T-shirts upon which an image is to be placed. An image can be placed on the object for example using a screen, as in silk screen printing, or the image can be printed as with an ink-jet printer. In any case, it is most practical for the object to be supported on a single flat plane. U.S. Pat. No. 4,753,164 by Barnes et al. discloses a moveable platen that can be positioned under a shirt pocket, for printing an image on the pocket in a silk screen printing machine. This apparatus makes it easier to properly align the shirt pocket with the silk screen apparatus. U.S. Pat. No. 6,908,190 by Iwalsuki et al. discloses a platen that is supported on one end and having open space around the platen to allow the platen to be inserted inside a T-shirt or other object. This, for example, allows an image to be printed on a front side of a T-shirt without the hazard of having ink flow through the front side and mark the back side of the shirt.

SUMMARY

It is an object of the present invention to provide an improved platen for use in printing images on an object.

It is a further object of the present invention to provide a platen with an adjustable surface area.

It is a still further object of the present invention to provide a platen that can be adjusted to recess thick portions of an object so as to present a flat surface to printing apparatus.

It is another object of the present invention to provide a platen that prevents thicker portions of an object to be printed upon from protruding upward and interfering with movement of an ink head.

It is an object of the present invention to provide a platen that has an adjustable surface area for recessing a button and/or zipper or other item of an article of clothing during printing on the article of clothing.

Briefly, an embodiment of the present invention includes a platen for use in printing on an object, wherein the platen has an adjustable area of a working surface on which to place the object. The platen surface includes a plurality of elements, wherein each element includes a flat surface that can be positioned at a working level at which the object is to be placed, and wherein an operator can insert or remove each element and thereby the corresponding flat surface of that element from the working level as required in order to provide a desired area of the working surface. In one embodiment, the platen includes a base plate and a plurality of elements which can be positioned on the base plate or removed to form a desired configuration of the working surface.

DETAILED DESCRIPTION OF THE INVENTION

Figure 1:
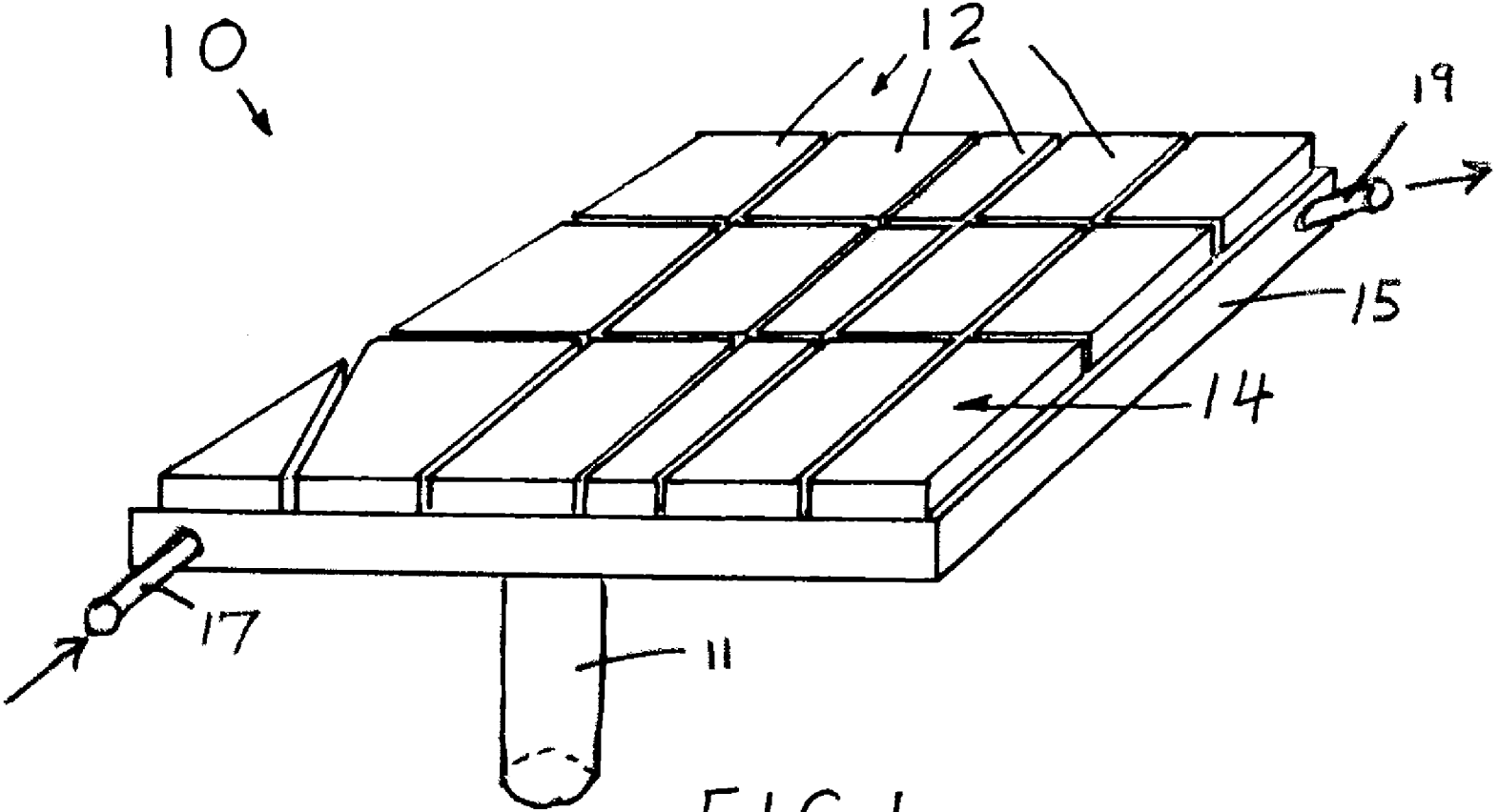
FIG. 1 shows a platen according to the present invention with removable surface elements for configuring a platen surface area.

A platen 10 according to the present invention is shown in the perspective view of FIG. 1. The platen 10 includes a plurality of surface elements 12, that can be displaced to configure a surface area 14.

Figure 2:
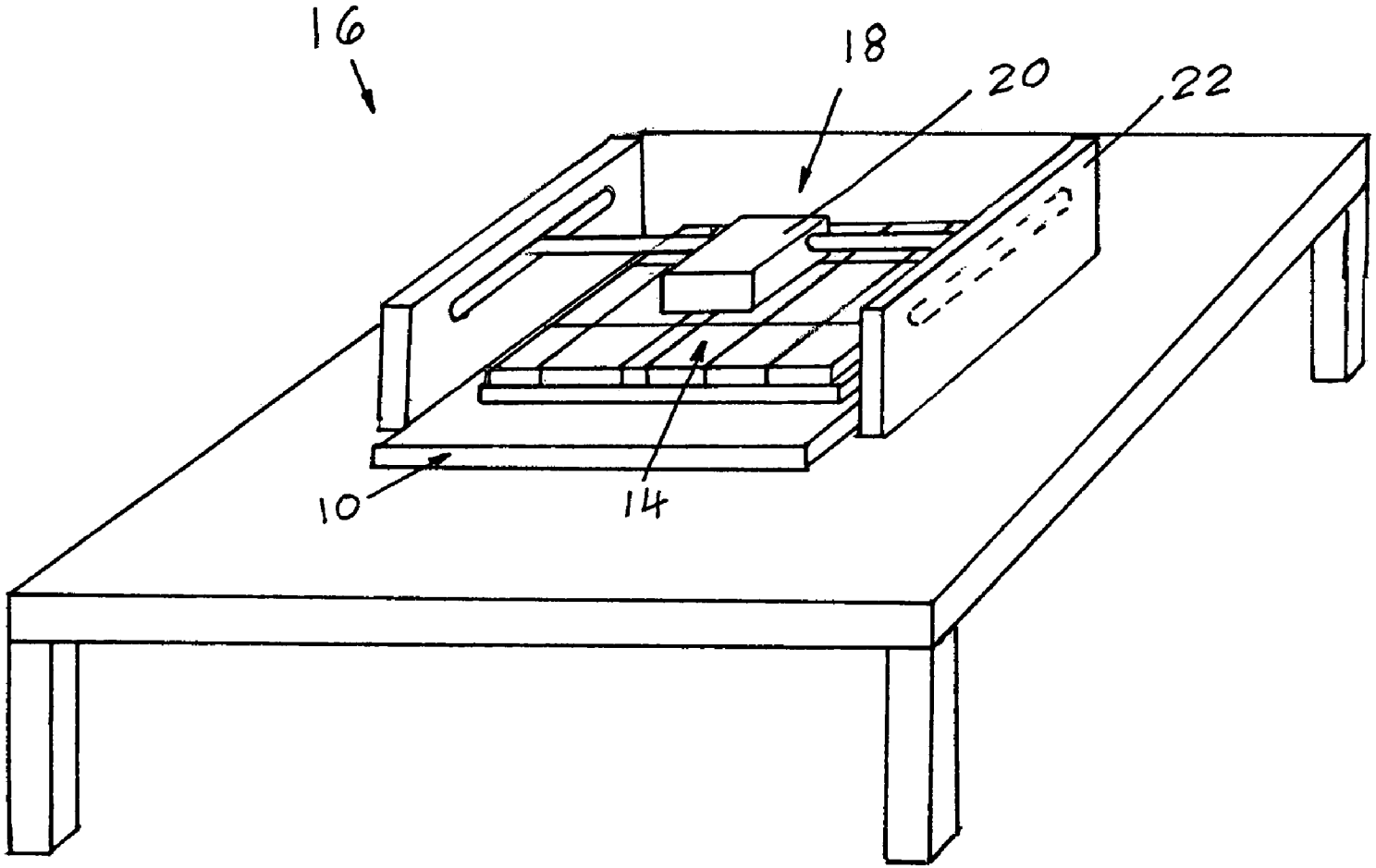
FIG. 2 is a perspective view for illustrating printing system assembly components including a platen according to the present invention.

FIG. 2 illustrates use of the platen 10 in a printing system 16 using an ink-jet printer 18. The printer 18 for example may include an ink cartridge apparatus 20, and apparatus 22 for moving the cartridge in two dimensions for printing on an object placed on the surface 14 of the platen 10. The ink cartridge apparatus 20, such as an ink-jet is illustrated as an example. Other apparatus, such as a silk screen apparatus can be used to place an image on an object on the platen 10 of the present invention.

Figure 3A:
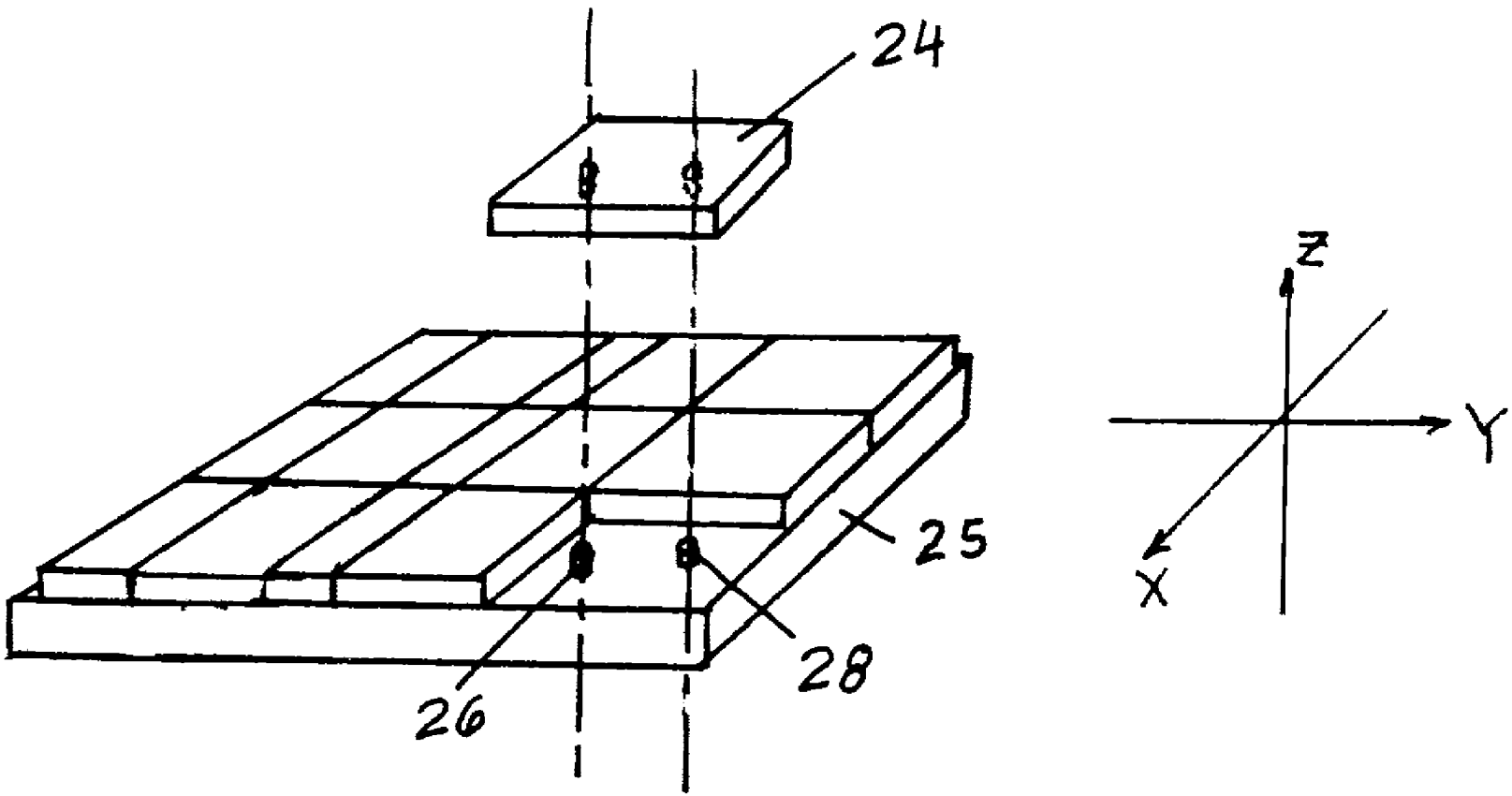
FIG. 3A illustrates use of dowel pins to hold surface elements in place.
Figure 3B:
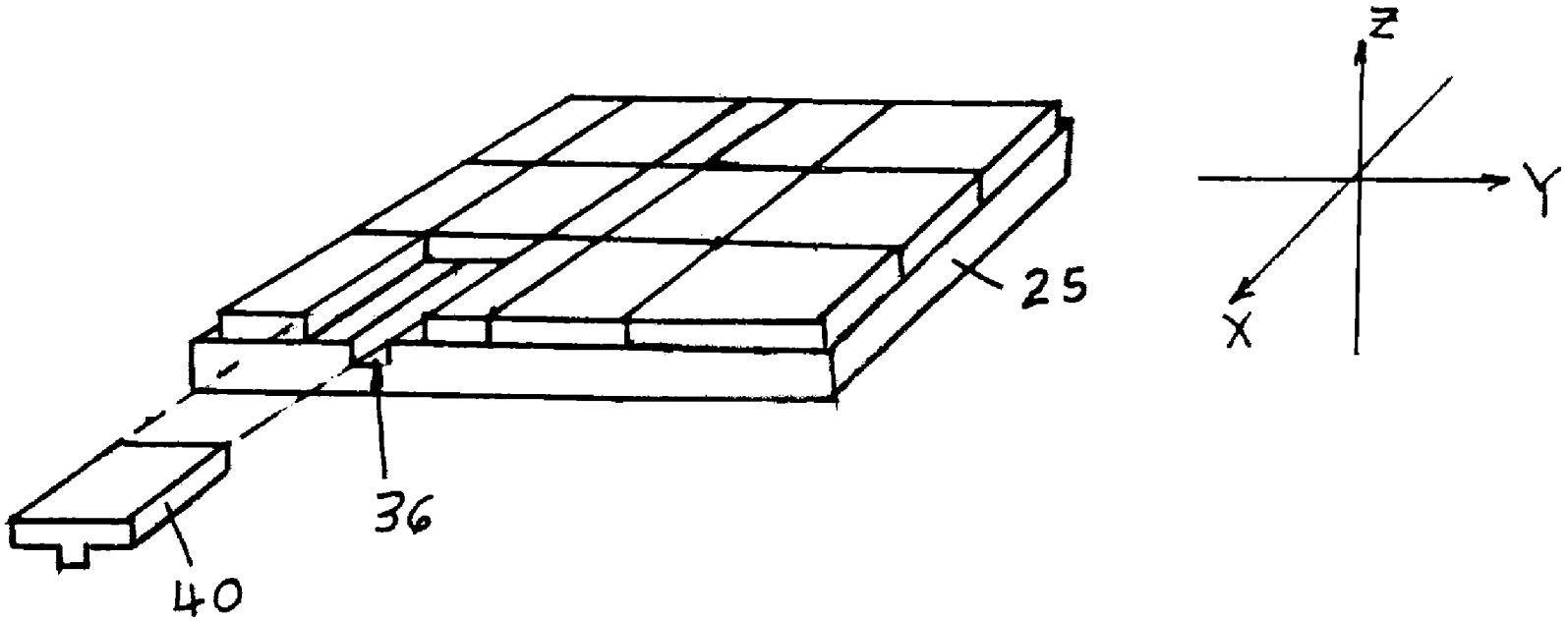
FIG. 3B illustrates use of a channel in the base for positioning surface elements.

FIG. 3A illustrates apparatus for holding a surface element 24 in place in an x-y plane on a base 25 using two dowel pins 26 and 28. FIG. 3B illustrates the use of a channel 36 in the base 25 for positioning surface element 40.

Figure 4:
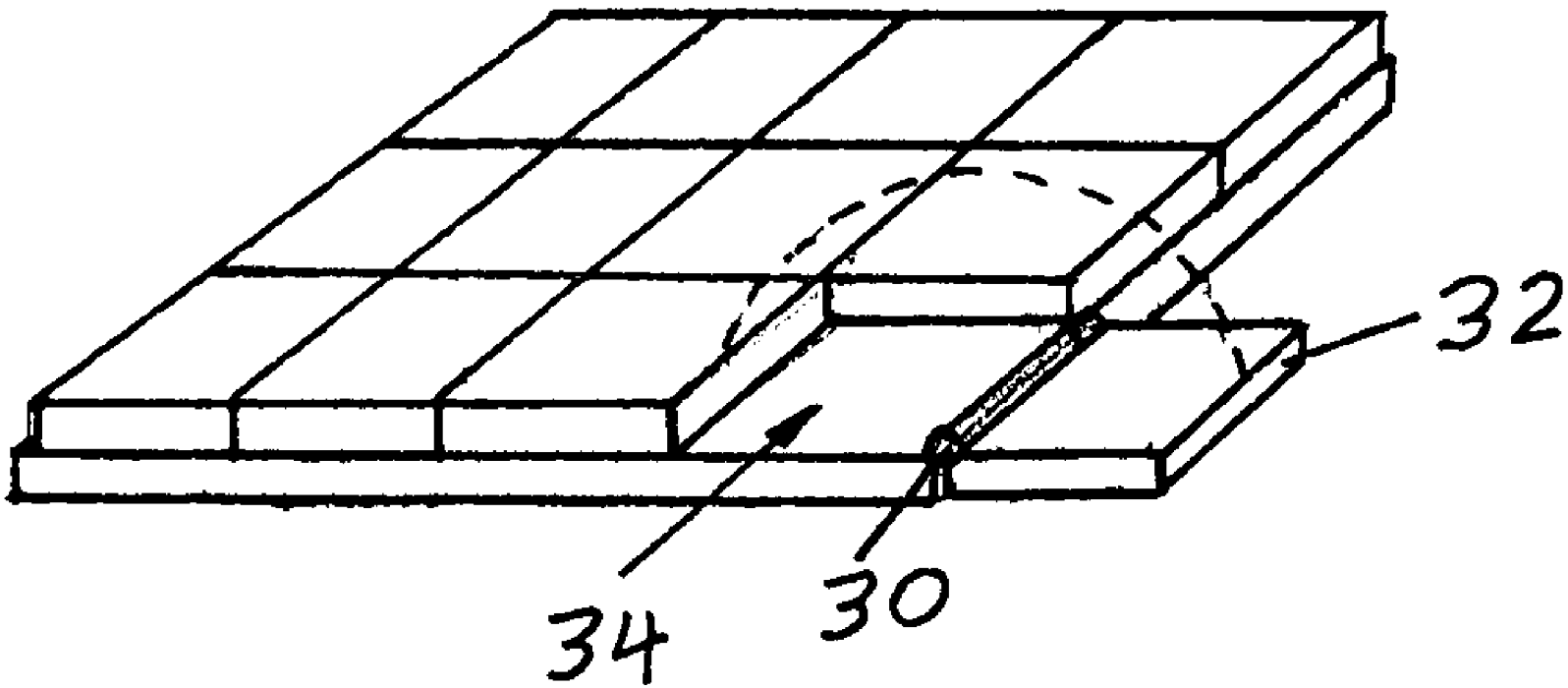
FIG. 4 illustrates the use of a hinge to facilitate removing an element.

FIG. 4 shows use of a hinge 30 to pivot a surface element 32 out of a position 34.

FIGS. 5A through 7C illustrate the use of the platen of the present invention in a system for printing an image on a shirt. When printing on a shirt, it is highly desirable, and generally necessary for the surface of the shirt to be relatively flat. If the printing apparatus is an ink-jet device, the ink nozzle vertical movement, for example, may not be sufficient to clear obstacles that project upward beyond the level of the surface to be printed upon. In a silk screen apparatus, the surface needs to be flat.

Figures 5A, 5B, 6A, 6B, 6C, 6D, 7A, 7B, 7C:
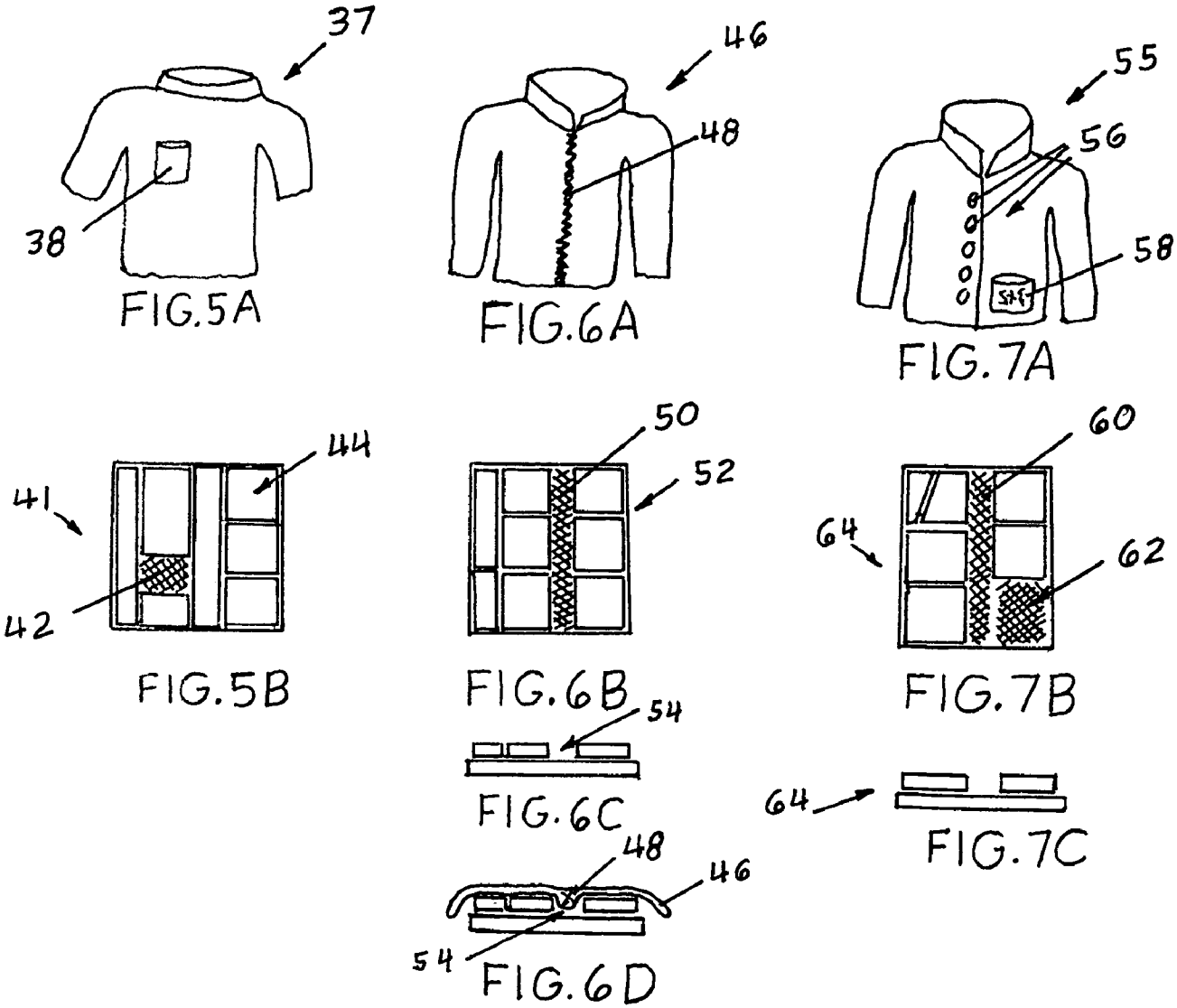
FIG. 5A illustrates a shirt upon which an image may be placed having a pocket with a thickness that might interfere with printing an image on the shirt.
FIG. 5B illustrates a platen surface configured with removable elements for recessing the pocket of the shirt of FIG. 5A.
FIG. 6A shows a shirt with a zipper that has a thickness that might interfere with printing on the shirt.
FIG. 6B shows a platen configured with an element removed so as allow the zipper of the shirt of FIG. 6A to be recessed so as to provide a surface without protrusions for printing on the shirt.
FIG. 6C shows an end view of the platen configuration of FIG. 6B.
FIG. 6D shows the end view of FIG. 6C with the shirt of FIG. 6A placed thereon with the zipper recessed in the space allowed by the platen.
FIG. 7A shows a shirt with both buttons and a pocket that protrude from the surface of the main portion of the shirt fabric which may interfere with printing on the shirt.
FIG. 7B shows a platen with removable elements configured to provide recess for the buttons and pocket of the shirt of FIG. 7A.
FIG. 7C shows an end view of the platen of FIG. 7B.

FIG. 5A shows a T-shirt 37 with a pocket 38 that more than doubles the shirt thickness in that area. FIG. 5B illustrates a platen 41 with a surface element removed from position 42 to allow the pocket 38 to sink into the depression, indicated in FIG. 5B with cross hatching, and thereby provide a planar surface 44 with no protrusions extending above the level of a single layer of shirt 37 fabric when the shirt 37 is placed on the platen 41.

FIG. 6A is a shirt 46 with a zipper 48. In order to depress the zipper to keep it from protruding upward, a surface element at 50 is removed from the platen 52, as shown in FIG. 6B. FIG. 6C is an end view of the platen of FIG. 6B, showing the space 54 for the zipper thickened area. FIG. 6D illustrates the shirt 46 laid on the platen with the zipper 48 depressed into the space 54.

FIG. 7A is a shirt 55 with buttons 56 and a pocket 58. FIG. 7B shows a platen 64 with surface elements removed from areas 60 and 62 to allow recessing the buttons 56 and pocket 58 of the shirt 55. FIG. 7C is an end view of the platen 64.

Some printing machines include a print head height adjustment feature that automatically adjusts up or down depending on the thickness of the object to be printed. For example, if a sweatshirt is printed the print head will be adjusted higher than if a T-shirt is printed. The present invention includes a height adjustment feature for the platen in cases where the print head height does not automatically adjust. The platen can be adjusted up or down by any of a variety of well-known mechanical techniques, such as a screw-threaded post base, a hydraulic system, locking points at different heights, etc. FIG. 1 illustrates a post 11 that may be driven by a screw-threaded or hydraulic system.

Another desirable feature that can be incorporated in the present invention is the ability to heat or cool the platen. A heated platen can enhance print transfer and adherence. Heat also serves to make material more supple, so that the material that is being printed upon is more easily smoothed, thereby ensuring an unwrinkled printing surface. Cooling ensures that (a) the platen/material will not overheat, and (b) can thicken the printing ink so that the ink sits on top of the item being printed upon. This allows more layers of ink without running and loss of resolution, and greater opacity in the printed item. It also stops upper ink layers from mixing with lower ink layers, which creates less color definition in the printed object.

The heating and cooling can be achieved using a variety of equipment heating and cooling techniques, including electrical heating, liquid or air heating and cooling, and air heating and cooling. For example, FIG. 1 illustrates a base 15 that may be liquid or air heated or cooled, with the liquid or air entering the base through port 17 and exiting at port 19.

The above description of the present invention illustrates a platen with a configurable surface area for accommodating irregularities in thickness of an object upon which an image is to be printed. The inventive platen serves to provide a flat working surface without protrusions for applying an image by any of various methods known to those skilled in the art, such as through use of an ink-jet or screen process. The illustrations of the platens according to the present invention as shown are presented to clearly demonstrate the principle and embodiment of the invention. Various constructional details, such as methods of attaching the platen to a table, etc. in a system are not shown. Such mechanical details will be apparent to those skilled in the art and can be incorporated without undue experimentation, and these are to be included in the present invention. The configuration of elements is given by example, and in particular for an embodiment addressing the use of the platen in placing an image on a shirt. Other configurations of surface elements, and apparatus for extracting and replacing a surface element for achieving a flat surface with an object placed thereon, will be apparent to those skilled in the art after reading the present disclosure, and these are to be included in the spirit of the present invention.

While certain representative embodiments and details have been shown for purposes of illustrating the invention, it will be apparent to those skilled in the art that various changes in the methods and apparatus disclosed herein may be made without departing from the scope of the invention which is defined in the appended claims.

What is claimed is:

1. A method of printing on an article of clothing having a plurality of thick portions arranged in a non-linear pattern, comprising the steps of:

(a) adjusting a platen by providing a plurality of recesses in a non-linear pattern in the platen to accommodate the plurality of thick portions of the article, wherein the platen includes a base having an upper planar surface and at least six surface elements, the surface elements removably securable to the base to provide an adjustable working area tailorable to the article to accommodate the plurality of thick portions of the article, the surface elements when secured to the base being restrained to have their upper surfaces define a plane and their lower surfaces having portions co-planar with and in contact with the base;

(b) placing the article on the platen such that the plurality of thick portions of the article are recessed below the upper planar surface of the platen; and (c) printing an image on said article, wherein the image is printed without having to rearrange the placement of the article on the platen to accommodate the plurality of thick portions of the article.

2. A method as recited in claim 1 further comprising the step of configuring said working area prior to said printing to provide a recessed area for receiving a thicker portion of said article.

3. A method as recited in claim 2 wherein said article is a shirt.

4. A method as recited in claim 3 wherein said shirt has a pocket, and said platen is configured to provide said recessed area for receiving said pocket.

5. A method as recited in claim 3 wherein said shirt has a zipper, and said platen is configured to provide said recessed area for receiving said zipper.

6. The method of claim 1, further comprising the step of heating the platen.

7. The method of claim 1, further comprising the step of cooling the platen.

8. The method of claim 1, further comprising adjusting the height of the platen to a selected level, wherein the selected level is determined by the thickness of the article.

* * * * *